US006457550B1

(12) United States Patent
Barry et al.

(10) Patent No.: US 6,457,550 B1
(45) Date of Patent: Oct. 1, 2002

(54) WEATHERPROOF SOUND ATTENUATING DEVICE

(75) Inventors: Charles L. Barry, Naples, FL (US); David P. Leclerc, Maple Grove, MN (US); Thanh K. Tang, St. Louis Park, MN (US); James L. Smith, Maple Grove, MN (US)

(73) Assignee: Twin City Fan Companies, Ltd., Minneapolis, MN (US)

( * ) Notice: Subject to any disclaimer, the term of this patent is extended or adjusted under 35 U.S.C. 154(b) by 0 days.

(21) Appl. No.: 09/800,186

(22) Filed: Mar. 6, 2001

(51) Int. Cl.[7] ..... E04F 17/04

(52) U.S. Cl. ..... 181/224; 181/222; 181/256; 181/252

(58) Field of Search ..... 181/224, 217, 181/218, 222, 252, 256

(56) References Cited

U.S. PATENT DOCUMENTS

| | | | | |
|---|---|---|---|---|
| 168,169 A | | 9/1875 | Mihan | 454/36 |
| 277,457 A | | 5/1883 | Campbell | 96/377 |
| 683,225 A | | 9/1901 | Rosen | 454/363 |
| 925,252 A | | 6/1909 | Warden | 454/358 |
| 1,183,804 A | | 5/1916 | Determan | 454/358 |
| 1,219,893 A | | 3/1917 | Woolf | 454/363 |
| 1,235,609 A | | 8/1917 | Sodemann | 454/36 |
| 1,888,428 A | | 11/1932 | Martin | 454/361 |
| 1,893,272 A | | 1/1933 | Clay | 454/361 |
| 1,966,220 A | | 7/1934 | Rentschler et al. | 250/27.5 |
| 2,112,608 A | | 3/1938 | Schmidt | 230/233 |
| 2,163,077 A | | 6/1939 | Wilson | 98/84 |
| 2,332,552 A | | 10/1943 | Belanger | 98/43 |
| 2,363,733 A | | 11/1944 | Karol | 98/84 |
| 2,392,742 A | | 1/1946 | Jenkins | 98/84 |
| 2,753,786 A | | 7/1956 | White | 98/84 |
| 3,125,286 A | | 3/1964 | Sanders | 230/233 |
| 3,177,795 A | | 4/1965 | Schutt | 98/40 |
| 3,330,379 A | * | 7/1967 | Cook | 181/224 |
| 3,855,910 A | * | 12/1974 | Brinton et al. | 454/365 |
| 5,473,124 A | | 12/1995 | Yazici et al. | 181/224 |

* cited by examiner

*Primary Examiner*—Shih-Yung Hsieh
(74) *Attorney, Agent, or Firm*—Nawrocki, Rooney & Sivertson, P.A.

(57) ABSTRACT

A sound attenuating device including a sound insulating structure and a windband. The sound insulating structure is constructed and arranged to receive vented air from an exhaust vent. The windband is affixed to the sound insulating structure and is constructed and arranged to prevent water from entering the sound insulating structure. The windband also provides a structure for attenuating sound.

22 Claims, 2 Drawing Sheets

WEATHERPROOF SOUND ATTENUATING DEVICE

BACKGROUND OF THE INVENTION

The present invention is generally related to fields such as industrial ventilation systems and the like. In particular, the present invention relates to a sound attenuating device that is attached to the exterior venting system of a structure and is constructed to prevent water from entering the venting system.

Traditionally, exhaust air carrying sound pollution has been damped by a sound silencer mounted to the end of an exhaust vent. This silencer contains sound insulation and reduces the overall amount of sound pollution exiting the exhaust vent. The sound silencer is typically cylindrical in shape and has sound insulating material therein. A damper is sometimes utilized on the silencer to allow the exhaust to escape when needed. The damper is then closed while the exhaust vent is not in use to protect the exhaust vent and silencer from the natural elements, such as rain water. A windband, typically only comprised of a sheet of material, such as sheet metal, formed into a cylindrical shape, may also be utilized on the silencer to help keep wind on the exterior of the structure from pulling the damper open or inhibiting the damper from closing. Traditionally, these three elements have not been specifically designed to be used together and, therefore, they are typically modified and bolted together. Furthermore, such structures may not adequately remove sound pollution existing within the exhaust, and therefore, the damping of the sound pollution may be improved.

SUMMARY OF THE INVENTION

The present invention provides a unitary sound attenuating device that comprises a sound insulating structure and a windband. The sound insulating structure is constructed and arranged to receive vented air from an exhaust vent attached to a structure. The windband provides a structure for attenuating sound. The windband also provides a structure for diverting water away from said sound insulating structure and, thereby, prevents water from entering the exhaust vent.

In one embodiment, the sound insulating structure has an exterior wall with the interior surface of the wall having sound insulation thereon. The sound insulation may be housed in a compartment comprised of at least an interior wall and the exterior wall. The interior wall may have a plurality of apertures therethrough to allow sound to pass through the wall.

The sound insulating structure may also have a sound attenuating structure positioned within the interior space defined within the interior surface of the exterior wall. The sound attenuating structure may also have an apertured outer surface and sound insulation positioned within the sound attenuating structure.

In one embodiment, the windband is defined by an exterior wall with sound insulation on its interior surface. The insulation may be housed in a compartment formed by the exterior wall and at least an interior wall. One embodiment of the device provides a windband that is capable of diverting water by utilizing a drain aperture either in the exterior wall of the windband or in the bottom surface of the windband. The windband may also utilize a bulb seal and/or a damper to divert water from the sound attenuating structure. The sound attenuating structure may have an interior cavity formed therein with the cavity in exhaust communication with the exhaust vent and having an output orifice.

The seal may be placed around the edge of the output orifice. In a preferred embodiment, a damper having two opposing lid portions is constructed and arranged to cover the output orifice of the sound attenuating structure. The lid portions may have overhanging edges that hang over the edge portion of the sound insulating structure adjacent to the output orifice.

The aforementioned benefits and other benefits including specific features of the invention will become clear from the following description by reference to the accompanying drawings.

DETAILED DESCRIPTION OF THE INVENTION

Figure 1:
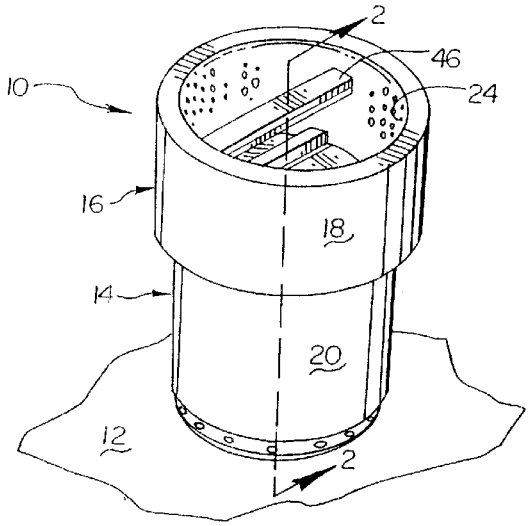
FIG. 1 is an elevated top side perspective view of a device according to the present invention.

Referring now to the drawings wherein like reference numerals denote like elements throughout the several views, FIG. 1 illustrates an embodiment of the present invention showing the device 10 being mounted to the periphery of an exhaust vent (not shown) of a structure 12. The exhaust vent may be the terminus of an exhaust duct, the outlet of an exhaust fan or any other known structure with the attachment being accomplished by any means known in the art. One such means, is as shown—bolting the device 10 to the structure 12. The device 10 generally comprises two portions, namely, the sound insulating structural portion 14 and the windband portion 16. The sound insulating portion 14 is constructed and arranged to minimize the sound emanating from the structure 14. The windband 16 is constructed and arranged to minimize the affect of the outside elements on the sound insulating structure 14 as well as the exhaust vent of the structure 12 and is designed to further reduce sound pollution exiting the exhaust vent.

Figure 2:
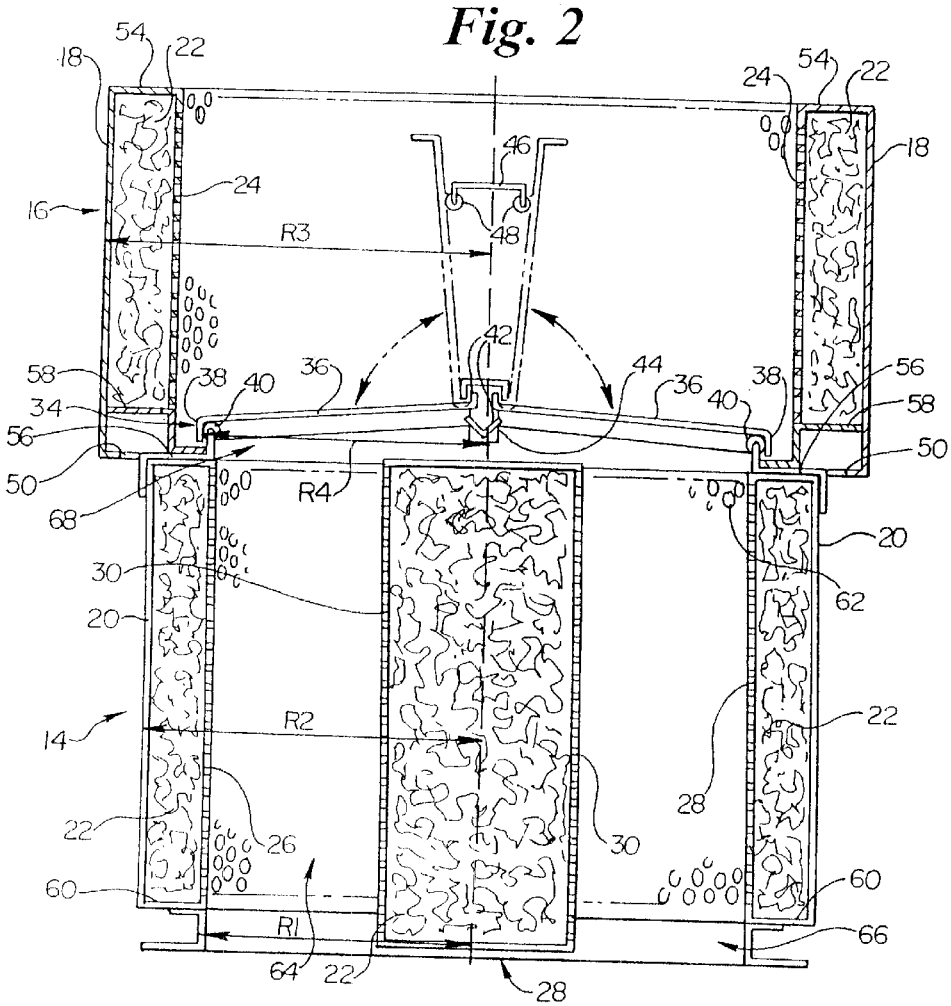
FIG. 2 is side cut-away view of the embodiment of the present invention taken along line 2—2 of FIG. 1.
Figure 3:
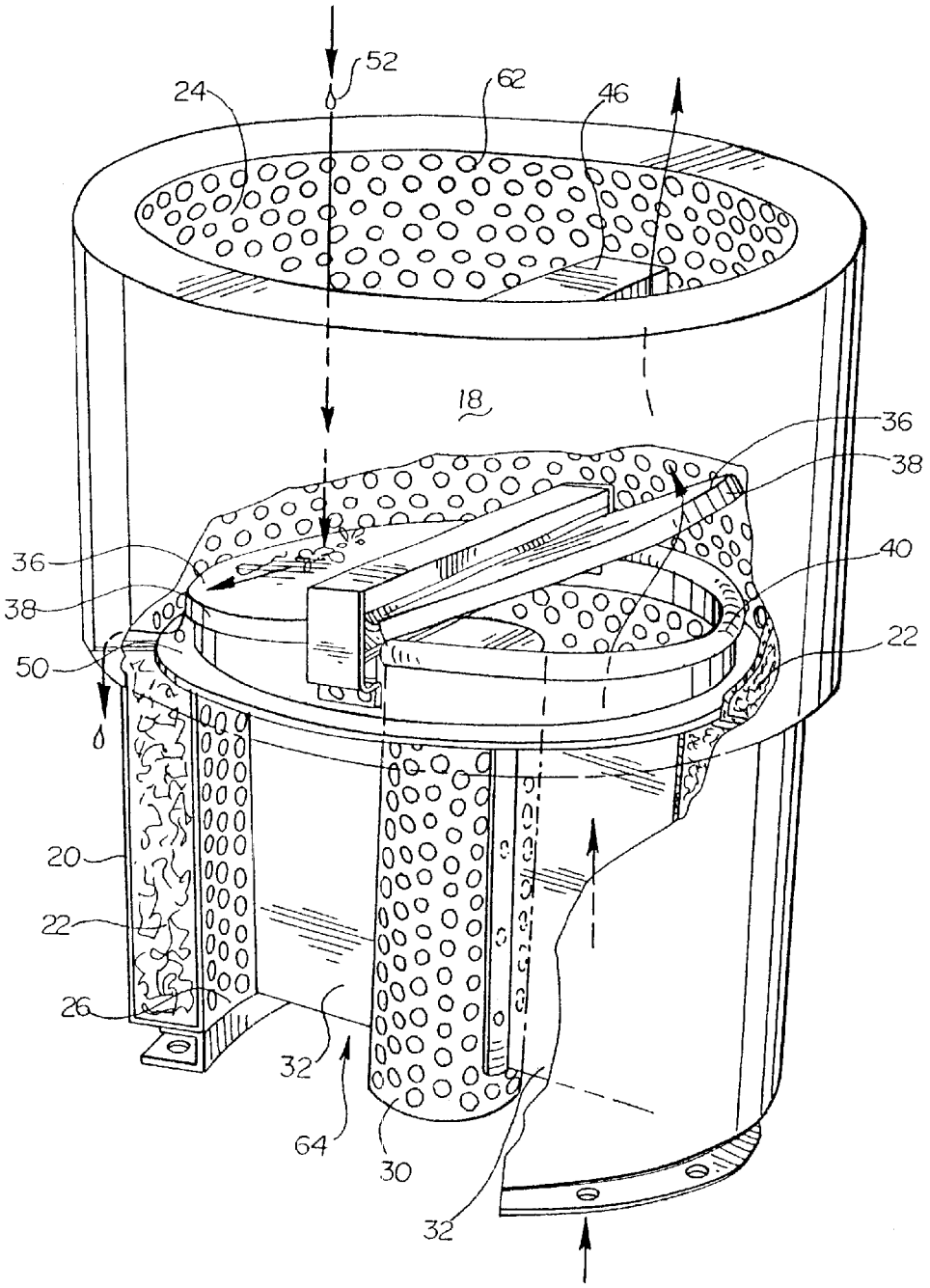
FIG. 3 is a side partial cut-away view of the embodiment of FIG. 1 illustrating the internal configuration of this embodiment of the invention.

FIGS. 2 and 3 illustrate the interior makeup of this embodiment of the present invention. In the illustrated embodiment, the device 10 has exterior walls 18 and 20 forming the exterior of both the sound insulating structure 14 and the windband 16. The interior surfaces of these walls 18 and 20 each preferably have sound insulation 22 positioned thereon. The insulation 22 is preferably water and air permeable and is preferably resistant to degradation by natural elements, such as water. Any suitable sound insulating material may be utilized. For example, glass or mineral wool fiber-type insulation are suitable for use with the present invention.

As illustrated, the insulation 22 in either or both the sound insulation structure 14 and the windband 16 may be housed within a compartment formed by the interior surface of the exterior wall 18 or 20 and an interior wall 24 or 26, respectively. Each compartment may also be comprised of a top surface 54 or 56 and bottom surface 58 or 60 in both the sound insulation structure 14 and the windband 16. The interior wall 24 or 26 has a plurality of apertures 62 thereon for the access of exhaust to the insulation 22. Since the windband 16 is exposed to the elements, the bottom surface 58 of the compartment within the windband 16 also has a plurality of apertures 62 for the passing of water therethrough.

As shown, the sound insulating structure 14 may comprise single or multiple cavities 64 therein that are in communication with a structure's exhaust vent for passage of exhaust from the vent to the exterior of the sound insulating structure 14. This cavity 64 has an input orifice 66 affixed to the exhaust vent and an output orifice 68 for the exhausting of exhaust.

The interior cavity 64 may have any interior configuration known in the art. One example is shown, wherein the interior cavity of the sound insulating structure 14 has a circular cylindrical shape and has a sound attenuating structure 28 positioned therein. The sound attenuating structure 28 shown is comprised of an outer surface 30 having a plurality of apertures thereon. The outer surface 30 defines an interior space and preferably has sound insulation 22 positioned therein. The sound attenuating structure 28 may be held in position by any means known in the art. For example, as shown, the structure is held in position be a plurality of vanes 32 attached between the outer surface 30 and the interior wall 26 of the sound insulating structure 14.

The output orifice may have a damper 34 arranged to cover the entirety of the orifice. In this way, natural elements can be prevented from entering the device 10 when the device is not in use. Any suitable damper may be utilized. For example, the device illustrated utilizes two opposing lid portions 36 that are mounted over the center of the orifice and that swing upwardly when the amount of exhaust acts to force them upward, the upward or open position being shown in phantom in FIG. 2. The lid portions 36 may have overhanging edges 38 that hang over the edge of the orifice to aid in keeping the elements out of the sound insulating structure 14.

A seal 40 positioned around the edge of the orifice may also be employed to aid in keeping undesirable material out of the structure. Furthermore, the lids 36 may have upwardly bent interior edges 42 that act in concert with a drain channel 44 mounted across the orifice to drain water away from the orifice, and onto the bottom surface 50 of the windband 16, when the lid portions 36 of the damper 34 are partially open. A damper stop structure 46 may also be employed to keep the lids 36 of the damper 34 from overextending. As shown, the damper stop 46 is provided by a plate having a pair of resilient bumpers 48 mounted thereon.

In the embodiment shown in the figures, the windband 16 comprises a bottom surface 50 wherein water would pool and fill the windband 16 or enter the sound insulating structure 14 if proper drainage is not provided. Drainage apertures are preferably provided at or near the bottom surface 50 of the windband. In the embodiment illustrated in the figures, the exhaust vent has a first radius $R_1$ that is equal to or smaller than the sound insulation structure 14 having a second radius $R_2$. The windband 16 has a third radius $R_3$ that is larger than the first and second radii $R_1$ and $R_2$. With this construction, drainage may be accomplished by placing the drainage apertures in the bottom surface 50 between the second and third radii $R_2$ and $R_3$. In this embodiment, the water then drains down either on or in proximity to the exterior surface 20 of the sound insulation structure 14. The lid portions 36 of the damper 34 preferably has a fourth radius $R_4$ that is between that of the first radius $R_1$ and the third radius $R_3$, thereby allowing it to completely cover the output orifice of the sound insulating structure 14.

FIG. 3 illustrates how this embodiment of the present invention effectuates the drainage of water from the device 10. A drop of water 52 is shown entering the interior of the windband 16. The water droplet 52 contacts the damper 34 and continues down the lid portion 36 and over the overhanging edge 38 of the lid 36. The droplet 52 then falls off the overhanging edge 38 and onto the bottom surface 50 of the windband 16. The droplet 52 then drains through an aperture formed in the bottom surface 50 and exits the device 10, falling along the outside of the sound insulating structure 14.

Since many possible embodiments may be made of the present invention without departing from the scope thereof, it is to be understood that all matter herein set forth or shown in the accompanying drawings is to be interpreted in the illustrative and not limiting sense.

What is claimed is:

1. A sound attenuating device, for attachment to an exhaust vent having an exit exhaust orifice, comprising;

a sound insulating structure constructed and arranged to receive vented air from the exit orifice of the vent; and a windband affixed to said sound insulating structure, having an interior space, and having means for attenuating sound and means for diverting water from within said interior space to outside said attenuating device, said windband defined by an exterior wall having an exterior surface and an interior surface, at least a portion of said interior surface having sound insulation thereon.

2. The device of claim 1, wherein said sound insulating structure is defined by an exterior wall having an exterior surface and an interior surface, said interior surface having sound insulation thereon.

3. The device of claim 2, wherein said sound insulating structure further comprises a compartment formed against the interior surface of said exterior wall wherein said sound insulation is housed, said compartment formed by at least an interior wall and said exterior wall.

4. The device of claim 3, wherein said interior wall of said compartment has a plurality of apertures therethrough.

5. The device of claim 1, wherein said sound insulating structure is defined by an exterior wall having an exterior surface and an interior surface, said interior surface defining an interior cavity having a sound attenuating structure positioned therein.

6. The device of claim 5, wherein said sound attenuating structure has an outer apertured surface defining an interior space.

7. The device of claim 6, wherein the interior space of said sound attenuating structure has sound insulation positioned therein.

8. The device of claim 1, wherein said windband further comprises a compartment formed against the interior surface of said exterior wall wherein said sound insulation is housed, said compartment formed by at least an interior wall and said exterior wall.

9. The device of claim 8, wherein said interior wall of said compartment has a plurality of apertures therethrough.

10. A sound attenuating device, for attachment to an exhaust vent having an exit exhaust orifice having a first radius, comprising;

a sound insulating structure having a second radius and being constructed and arranged to receive vented air from the exit orifice; and a windband mounted to said sound insulating structure, having an interior space, and having a third radius and means for attenuating sound and means for diverting water from within said interior space to outside said attenuating device, wherein the first radius is smaller than the third radius and smaller than or equal to the second radius, said windband defined by an exterior wall having an exterior surface and an interior surface, at least a portion of said interior surface having sound insulation thereon.

11. The device of claim 10, wherein said windband is comprised of an exterior wall, having an exterior surface and an interior surface with said exterior wall defining a cavity therein, and a bottom surface connecting said sound insulating structure to said exterior wall of said windband.

12. The device of claim 11, wherein said windband is further comprised of a compartment formed between said interior surface of said exterior wall and an interior wall having a plurality of apertures therein.

13. A sound attenuating device, for attachment to an exhaust vent having an exit exhaust orifice, comprising;

a sound insulating structure constructed and arranged to receive vented air from the exit orifice of the vent; and a windband affixed to said sound insulating structure having means for attenuating sound and means for diverting water away from said sound insulating structure, said means for diverting water is comprised of a damper assembly having at least one lid portion and a seal to cover the orifice of said exhaust vent and to prevent water from entering said vent.

14. A sound attenuating device, for attachment to an exhaust vent having an exit exhaust orifice having a first radius, comprising;

a sound insulating structure having a second radius and being constructed and arranged to receive vented air from the exit orifice; and a windband mounted to said sound insulating structure and having a third radius and means for attenuating sound and means for diverting water away from the sound insulating structure, wherein the first radius is smaller than the third radius and smaller than or equal to the second radius, said windband comprised of an exterior wall, having an exterior surface and an interior surface with said exterior wall defining a cavity therein, and a bottom surface connecting said sound insulating structure to said exterior wall of said windband, said means for diverting water being comprised of a drain aperture in the exterior wall in proximity to said bottom surface.

15. A sound attenuating device, for attachment to an exhaust vent having an exit exhaust orifice having a first radius, comprising;

a sound insulating structure having a second radius and being constructed and arranged to receive vented air from the exit orifice; and a windband mounted to said sound insulating structure and having a third radius and means for attenuating sound and means for diverting water away from the sound insulating structure, wherein the first radius is smaller than the third radius and smaller than or equal to the second radius, said sound insulating structure defines an interior cavity in air flow communication with said structure, said structure having an output orifice having an edge therearound, and wherein said means for diverting water is provided by a damper comprised of two opposing lid portions constructed and arranged to cover said orifice.

16. The device of claim 15, wherein said damper has a fourth radius that is larger than said first radius, but smaller than said third radius, and wherein said lid portions have overhanging edges that hang over the edge of said orifice.

17. The device of claim 16, wherein said means for diverting water is comprised of a drain aperture in the bottom surface positioned between the second and fourth radii.

18. The device of claim 16, wherein said means for preventing water from entering the ventilation shaft is provided by the combination of a seal placed around the edge of said orifice and two opposing lid portions having overhanging edges that hang over the edge of said orifice.

19. The device of claim 15, wherein said means for preventing water from entering the ventilation shaft is provided by a seal placed around the edge of said orifice.

20. A sound attenuating device, for attachment to an exhaust vent having an exit exhaust orifice, comprising;

a sound insulating structure constructed and arranged to receive vented air from the exit orifice of the vent; and a windband affixed to said sound insulating structure, having an interior space, and having a structure constructed and arranged to attenuate sound and structure constructed and arranged to divert water from within said interior space to outside said attenuating device.

21. A sound attenuating device, for attachment to an exhaust vent having an exit exhaust orifice, comprising;

a sound insulating structure constructed and arranged to receive vented air from the exit orifice of the vent; and a windband affixed to said sound insulating structure having means for attenuating sound and movable means for diverting water away from said sound insulating structure.

22. The device of claim 21, wherein said movable means is comprised of at least one movable lid portion.

* * * * *